US009126219B2

(12) United States Patent
Ovchinnikov et al.

(10) Patent No.: US 9,126,219 B2
(45) Date of Patent: Sep. 8, 2015

(54) ACOUSTIC STREAMING FLUID EJECTOR

(71) Applicant: Alcon Research, Ltd., Fort Worth, TX (US)

(72) Inventors: Mikhail Ovchinnikov, Dana Point, CA (US); Satish Yalamanchili, Irvine, CA (US); Jianbo Zhou, Rancho Santa Margarita, CA (US)

(73) Assignee: Alcon Research, Ltd., Fort Worth, TX (US)

( * ) Notice: Subject to any disclaimer, the term of this patent is extended or adjusted under 35 U.S.C. 154(b) by 0 days.

(21) Appl. No.: 14/019,958

(22) Filed: Sep. 6, 2013

(65) Prior Publication Data

US 2014/0263724 A1 Sep. 18, 2014

Related U.S. Application Data

(60) Provisional application No. 61/793,451, filed on Mar. 15, 2013.

(51) Int. Cl.
*B41J 2/14* (2006.01)
*B05B 17/06* (2006.01)

(52) U.S. Cl.
CPC ..... *B05B 17/0615* (2013.01); *B41J 2/14008* (2013.01); *B41J 2/14201* (2013.01)

(58) Field of Classification Search
CPC ..... B41J 2/14201; B41J 2/1404; B41J 2/135; B05B 1/3442; B05B 1/34; B05B 1/3426; B05B 1/3436; B05B 1/3447; B05B 1/262; B05B 1/265; B05B 1/267; B05B 17/06
USPC ..... 347/47; 239/589, 589.1, 102.1, 102.2
See application file for complete search history.

(56) References Cited

U.S. PATENT DOCUMENTS

| | | | |
|---|---|---|---|
| 1,061,142 | A | 5/1913 | Tesla |
| 1,061,206 | A | 5/1913 | Tesla |
| 3,487,784 | A | 1/1970 | Rafferty et al. |
| 3,589,363 | A | 6/1971 | Banko et al. |
| 3,724,974 | A | 4/1973 | Molimard |
| 3,784,323 | A | 1/1974 | Sausse |
| 3,996,935 | A | 12/1976 | Banko |

(Continued)

FOREIGN PATENT DOCUMENTS

| | | |
|---|---|---|
| CA | 2316640 | 2/2001 |
| CA | 2649867 A1 | 6/2001 |

(Continued)

OTHER PUBLICATIONS

International Search Report for PCT/US2010/058931, filed Dec. 3, 2010, Publication No. 2011071775, Published Jun. 16, 2011, 2 pages.

(Continued)

*Primary Examiner* — Alessandro Amari
*Assistant Examiner* — Michael Konczal
(74) *Attorney, Agent, or Firm* — Haynes and Boone, LLP

(57) ABSTRACT

An acoustic streaming fluid ejector includes a fluid filled chamber having an opening, a selectively vibrating flow generator having a sharp edge pointed toward the opening, and a driving device configured to vibrate one of the flow generator and the chamber to create a streaming fluid flow in a direction away from the sharp edge through the opening. Methods are also disclosed.

20 Claims, 5 Drawing Sheets

(56) References Cited

U.S. PATENT DOCUMENTS 4,140,118 A 2/1979 Jassawalla
4,187,057 A 2/1980 Xanthopoulos
4,205,948 A 6/1980 Jones
4,255,081 A 3/1981 Oklejas et al.
4,392,794 A 7/1983 Foxcroft
4,479,761 A 10/1984 Bilstad et al.
4,493,706 A 1/1985 Borsanyi et al.
4,530,647 A 7/1985 Uno
4,537,561 A 8/1985 Xanthopoulos
4,657,490 A 4/1987 Abbott
4,661,093 A 4/1987 Beck et al.
4,684,328 A 8/1987 Murphy
4,705,500 A 11/1987 Reimels et al.
4,713,051 A 12/1987 Steppe et al.
4,758,238 A 7/1988 Sundblom et al.
4,764,165 A 8/1988 Reimels et al.
4,768,547 A 9/1988 Danby et al.
4,798,580 A 1/1989 DeMeo et al.
4,838,865 A 6/1989 Flank et al.
4,861,332 A 8/1989 Parisi
4,909,710 A 3/1990 Kaplan et al.
4,909,713 A 3/1990 Finsterwald et al.
4,921,477 A 5/1990 Davis
4,923,375 A 5/1990 Ejlersen
4,935,005 A 6/1990 Haines
4,963,131 A 10/1990 Wortrich
5,041,096 A 8/1991 Beuchat et al.
5,046,486 A 9/1991 Grulke et al.
5,106,366 A 4/1992 Steppe
5,185,002 A 2/1993 Venturini
5,195,960 A 3/1993 Hossin et al.
5,207,647 A 5/1993 Phelps
5,257,917 A 11/1993 Minarik et al.
5,267,956 A 12/1993 Beuchat
5,273,517 A 12/1993 Barone et al.
5,302,093 A 4/1994 Owens et al.
5,316,440 A 5/1994 Kijima et al.
5,350,357 A 9/1994 Kamen et al.
5,364,342 A 11/1994 Beuchat et al.
5,392,653 A 2/1995 Zanger et al.
5,403,277 A 4/1995 Dodge et al.
5,429,485 A 7/1995 Dodge
5,429,602 A 7/1995 Hauser
5,460,490 A 10/1995 Carr et al.
5,462,416 A 10/1995 Dennehey et al.
5,470,312 A 11/1995 Zanger et al.
5,484,239 A 1/1996 Chapman et al.
5,487,747 A 1/1996 Stagmann et al.
5,518,378 A 5/1996 Neftel et al.
5,533,976 A 7/1996 Zaleski et al.
5,542,918 A 8/1996 Atkinson
5,554,013 A 9/1996 Owens et al.
5,575,632 A 11/1996 Morris et al.
5,588,815 A 12/1996 Zaleski
5,630,711 A 5/1997 Luedtke et al.
5,697,910 A 12/1997 Cole et al.
5,705,018 A 1/1998 Hartley
5,709,539 A 1/1998 Hammer et al.
5,733,256 A 3/1998 Costin
5,746,708 A 5/1998 Giesler et al.
5,746,719 A 5/1998 Farra et al.
5,759,017 A 6/1998 Patton et al.
5,788,667 A 8/1998 Stoller
5,810,765 A 9/1998 Oda
5,853,386 A 12/1998 Davis et al.
5,879,363 A 3/1999 Urich
5,897,524 A 4/1999 Wortrich et al.
5,906,598 A 5/1999 Giesler et al.
5,910,110 A 6/1999 Bastable
5,927,956 A 7/1999 Lim et al.
5,951,581 A 9/1999 Saadat et al.
5,972,012 A 10/1999 Ream et al.
5,996,634 A 12/1999 Dennchey et al.
6,012,999 A 1/2000 Patterson
6,058,779 A 5/2000 Cole
6,109,895 A 8/2000 Ray et al.
6,117,149 A 9/2000 Sorensen et al.
6,129,699 A 10/2000 Haight et al.
6,217,543 B1 4/2001 Anis et al.
6,241,700 B1 6/2001 Leukanech
6,293,926 B1 9/2001 Sorensen
6,296,460 B1 10/2001 Smith
6,416,293 B1 7/2002 Bouchard et al.
6,491,661 B1 12/2002 Boukhny et al.
6,527,765 B2 3/2003 Kelman et al.
6,551,080 B2 4/2003 Andersen et al.
6,572,349 B2 6/2003 Sorensen et al.
6,599,277 B2 7/2003 Neubert
6,689,146 B1 2/2004 Himes
6,723,065 B2 4/2004 Kishimoto
6,749,403 B2 6/2004 Bryant et al.
6,811,386 B2 11/2004 Hedington et al.
6,814,547 B2 11/2004 Childers et al.
6,868,987 B2 3/2005 Hedington
6,958,058 B1 10/2005 Hunter, Sr. et al.
6,962,488 B2 11/2005 Davis et al.
7,063,688 B2 6/2006 Say
7,070,574 B2 7/2006 Jackson et al.
7,144,383 B2 12/2006 Arnett et al.
7,150,607 B2 12/2006 Pelmulder et al.
7,238,164 B2 7/2007 Childers et al.
7,273,359 B2 9/2007 Blight et al.
7,393,189 B2 7/2008 Davis et al.
7,445,436 B2 11/2008 Mittelstein et al.
7,540,855 B2 6/2009 Lumpkin et al.
7,604,610 B2 10/2009 Shener et al.
7,632,080 B2 12/2009 Tracey et al.
7,645,127 B2 1/2010 Hagen et al.
7,695,242 B2 4/2010 Fuller
7,758,515 B2 7/2010 Hibner
7,775,780 B2 8/2010 Hopkins et al.
7,967,777 B2 6/2011 Edwards et al.
8,070,712 B2 12/2011 Muri et al.
8,087,909 B2 1/2012 Shener
8,162,633 B2 4/2012 Edwards
2001/0016706 A1 8/2001 Leukanech et al.
2002/0062105 A1 5/2002 Tanner
2002/0077587 A1 6/2002 Boukhny et al.
2003/0108429 A1 6/2003 Angelini et al.
2003/0199803 A1 10/2003 Robinson et al.
2004/0122381 A1 6/2004 Arnold
2004/0253129 A1 12/2004 Sorensen et al.
2005/0049539 A1 3/2005 O'Hara, Jr. et al.
2005/0100450 A1 5/2005 Bryant et al.
2006/0000925 A1* 1/2006 Maher et al. ..... 239/102.1
2006/0093989 A1 5/2006 Hahn et al.
2006/0122556 A1 6/2006 Kumar et al.
2006/0245964 A1 11/2006 Koslov
2006/0253194 A1 11/2006 Dial
2007/0078370 A1 4/2007 Shener et al.
2007/0078379 A1 4/2007 Boukhny et al.
2007/0100316 A1 5/2007 Traxinger
2007/0135760 A1 6/2007 Williams
2007/0217919 A1 9/2007 Gordon et al.
2007/0278155 A1 12/2007 Lo
2007/0287959 A1 12/2007 Walter et al.
2008/0097320 A1 4/2008 Moore et al.
2008/0112828 A1 5/2008 Muri et al.
2008/0114289 A1 5/2008 Muri et al.
2008/0114291 A1 5/2008 Muri et al.
2008/0114301 A1 5/2008 Bandhauer et al.
2008/0114311 A1 5/2008 Muri et al.
2008/0114312 A1 5/2008 Muri et al.
2008/0114372 A1 5/2008 Edwards et al.
2008/0200878 A1 8/2008 Davis et al.
2008/0220092 A1 9/2008 Dipierro et al.
2008/0240951 A1 10/2008 Demash et al.
2009/0012460 A1 1/2009 Steck et al.
2009/0035164 A1 2/2009 Edwards
2009/0060756 A1 3/2009 Jones
2009/0084718 A1 4/2009 Prisco et al.
2009/0246035 A1 10/2009 Patzer
2009/0299272 A1 12/2009 Hopping et al.
2009/0317271 A1 12/2009 Gill et al.

(56) References Cited

U.S. PATENT DOCUMENTS

| | | | |
|---|---|---|---|
| 2010/0125257 | A1 | 5/2010 | Perkins et al. |
| 2010/0130920 | A1 | 5/2010 | Lo et al. |
| 2010/0130934 | A1 | 5/2010 | Rochat |
| 2010/0145259 | A1 | 6/2010 | Nash et al. |
| 2010/0191178 | A1 | 7/2010 | Ross et al. |
| 2010/0228146 | A1 | 9/2010 | Hibner |
| 2010/0241044 | A1 | 9/2010 | Caleffi et al. |
| 2010/0280435 | A1 | 11/2010 | Raney et al. |
| 2010/0286791 | A1 | 11/2010 | Goldsmith |
| 2011/0092891 | A1 | 4/2011 | Gerg et al. |
| 2011/0137231 | A1 | 6/2011 | Sorensen et al. |
| 2011/0144567 | A1 | 6/2011 | Sorensen et al. |
| 2012/0041358 | A1 | 2/2012 | Mann et al. |
| 2012/0083728 | A1 | 4/2012 | Sorensen et al. |

FOREIGN PATENT DOCUMENTS

| | | | |
|---|---|---|---|
| CA | 2743969 | A1 | 3/2005 |
| CA | 2649867 | C | 6/2010 |
| CN | 101023898 | | 8/2007 |
| DE | 3809582 | | 10/1989 |
| DE | 19749358 | | 5/1998 |
| DE | 19711675 | | 10/1998 |
| DE | 19856744 | | 6/2000 |
| DE | 10034711 | B4 | 2/2002 |
| DE | 10034711 | A1 | 4/2006 |
| DE | 102007044790 | | 4/2009 |
| EP | 0200448 | | 5/1986 |
| EP | 0320963 | | 6/1989 |
| EP | 0362822 | | 4/1990 |
| EP | 518050 | A1 | 12/1992 |
| EP | 518050 | B1 | 7/1996 |
| EP | 0944404 | | 9/1999 |
| EP | 1140257 | | 10/2001 |
| EP | 1258260 | | 11/2002 |
| EP | 964711 | | 4/2005 |
| EP | 1810702 | | 7/2007 |
| EP | 2173404 | | 4/2010 |
| EP | 2509659 | | 10/2012 |
| FR | 2466641 | | 4/1981 |
| FR | 2797190 | | 2/2001 |
| GB | 2174763 | | 11/1986 |
| JP | 63-290564 | | 11/1988 |
| JP | 02070987 | | 3/1990 |
| JP | H03-164586 | | 7/1991 |
| JP | 2002-248117 | | 9/2002 |
| JP | 2007-507636 | | 3/2007 |
| JP | 2007-198382 | | 8/2007 |
| JP | 2007-247646 | | 9/2007 |
| JP | 2008-546501 | | 12/2008 |
| RU | 2197277 | | 1/2003 |
| RU | 2241887 | | 12/2004 |
| SU | 1533696 | | 1/1990 |
| SU | 1590649 | | 9/1990 |
| WO | WO 98/18507 | | 5/1998 |
| WO | WO 98/24495 | | 6/1998 |
| WO | WO 99/38549 | | 8/1999 |
| WO | WO 00/22995 | | 4/2000 |
| WO | WO 00/33898 | | 6/2000 |
| WO | WO 00/53136 | | 9/2000 |
| WO | WO 03 073969 | | 9/2003 |
| WO | WO 2005009511 | A2 | 2/2005 |
| WO | WO 2005009511 | A3 | 6/2005 |
| WO | WO 2008/131357 | | 10/2008 |
| WO | WO 2009/005900 | | 1/2009 |
| WO | WO 2009/146913 | A2 | 12/2009 |
| WO | WO 2009/146913 | A3 | 2/2010 |
| WO | WO 2010/061863 | | 6/2010 |
| WO | WO 2010/129128 | | 11/2010 |
| WO | WO 2011/071775 | | 6/2011 |
| WO | WO 2012048261 | A2 | 4/2012 |
| WO | WO 2012048261 | A3 | 6/2012 |

OTHER PUBLICATIONS

Written Opinion of the International Searching Authority, International Application No. PCT/US2010/058931, Feb. 1, 2011, 4 pages.
International Search Report for PCT/US2010/059032, filed Dec. 6, 2010, Publication No. 2011075332, Published Jun. 23, 2011, 2 pages.
Written Opinion of the International Searching Authority, International Application No. PCT/US2010/059032, Jan. 31, 2011, 5 pages.
(Citing Office Action) Examiner Edelmira Bosques, Non-Final Office Action, U.S. Appl. No. 12/637,886, Oct. 3, 2011, 11 pages.
Supplementary European Search Report for Application No. EP 10836456.3, Publication No. EP 2509659, Published Oct. 17, 2012, dated Mar. 20, 2013, 5 pages.
Supplementary European Search Report for Application No. EP 10838118.7, Publication No. EP2512554, Published Oct. 24, 2012, dated Apr. 15, 2013, 6 pages.
Milutinovic, et al., "Phacoemulsification Fluidics System Having a Single Pump Head," U.S. Appl. No. 12/818,682, filed Jun. 18, 2010, 28 pages.
International Searching Authority, Written Opinion of the International Searching Authority, International Application No. PCT/US2010/030168, Aug. 3, 2010, 8 pages.
International Search Report and Written Opinion of the International Searching Authority, International Application No. PCT/US2014/027271, filed Mar. 14, 2014, dated Jul. 28, 2014, 8 pages.
International Search Report and Written Opinion of the International Searching Authority, International Application No. PCT/US2014/027233, filed Mar. 14, 2014, dated Jul. 31, 2014, 10 pages.
International Search Report and Written Opinion of the International Searching Authority, International Application No. PCT/US2014/027307, filed Mar. 14, 2014, dated Jul. 30, 2014, 7 pages.
Sorensen, Gary, Phacoemulsification Hand Piece with Integrated Aspiration Pump, U.S. Appl. No. 13/325,549, filed Dec. 14, 2011, 18 pages.
http://www.advancedfluid.com/discflo/concepts.htm. Web archive dated Aug. 8, 2008, 3 pages.
Ovchinnikov et al., Acoustic Streaming of A Sharp Edge, Journal of Acoustical Society of America, 136 (1), Jul. 2014, pp. 22-29.

* cited by examiner

ACOUSTIC STREAMING FLUID EJECTOR

CROSS-REFERENCE TO RELATED APPLICATIONS

This application claims the benefit of U.S. Provisional Application No. 61/793,451, filed Mar. 15, 2013, the entire contents of which are included herein by reference.

BACKGROUND

The present disclosure relates to acoustic streaming fluid injectors for inkjet printers, drug delivery devices, and screening devices for drug discovery and DNA sequencing, among other applications.

Inkjet printing is rapidly becoming an increasingly important technology. Aside from consumer market, it is currently used in industrial printing, 3-D printing for rapid prototyping, circuit board printing, LCD and OLED display production, and a number of other industries. New applications of the technology for diagnostics and drug discovery industry are being investigated.

Currently there are two major technologies used in ink-jet printing, thermal and piezoelectric. The thermal design, commonly used in consumer ink-jet printers utilizes the production of bubbles by heating an electrode to eject a droplet of water out of a nozzle. The main disadvantage of this technology is that it works only with water as a solvent. The piezoelectric design more commonly used in commercial printers utilizes the piezoelectric diaphragms that change the volume of the chamber. The main limitations of this design are the price, printing speed, and the size of the droplets.

The present disclosure addresses one or more deficiencies in the prior art.

SUMMARY

In an exemplary aspect, the present disclosure is directed to an acoustic streaming fluid ejector that includes a fluid filled chamber having an opening, a selectively vibrating flow generator having a sharp edge pointed toward the opening, and a driving device configured to vibrate one of the flow generator and the chamber to create a streaming fluid flow in a direction away from the sharp edge through the opening.

In an aspect, the flow generator comprises two nonparallel surfaces forming an angle, the nonparallel surfaces being symmetrically disposed about an axis aligned with an axis through the opening. In an aspect, the two nonparallel surfaces converge to form the sharp edge. In an aspect, the sharp edge has an angle of 90 degrees or less. In an aspect, the driving device is configured to vibrate the flow generator at the resonance frequency of the flow generator. In an aspect, the driving device is one of piezoelectric stack and a coil. In an aspect, the opening is disposed directly proximate the sharp edge of the flow generator. In an aspect, the fluid is a drug for treating a condition. In an aspect, the fluid is an ink. In an aspect, the fluid is non-water soluble.

In an exemplary aspect, the present disclosure is directed to an acoustic streaming fluid ejector including a fluid reservoir, a fluid filled chamber in communication with the reservoir, the chamber having an opening, and a selectively, vibrating flow generator having a sharp edge. A driving device is configured to vibrate one of the flow generator and the chamber to create a streaming fluid flow in a direction away from the sharp edge in the chamber.

In an aspect, the sharp edge has an angle of 90 degrees or less. In an aspect, the driving device is configured to vibrate the flow generator at the resonance frequency of the flow generator. In an aspect, the driving device is a piezoelectric stack. In an aspect, the flow generator comprises two nonparallel surfaces forming an angle, the nonparallel surfaces being symmetrically disposed about an axis aligned with an axis through the opening. In an aspect, the two nonparallel surfaces converge to form the sharp edge. In an aspect, the driving device is configured to vibrate the flow generator at the resonance frequency of the flow generator.

In an exemplary aspect, the present disclosure is directed to a method including providing a flow generator in a fluid-filled chamber having an opening, the flow generator having a sharp edge defined by two nonparallel surfaces forming an angle, the nonparallel surfaces being symmetrically disposed about an axis aligned with an axis through the opening; and selectively vibrating the flow generator with a driving device to vibrate the sharp edge of the flow generator to eject a fluid droplet from the chamber and out of the opening.

In an aspect, vibrating the flow generator with a driving device comprises vibrating the flow generator with a piezoelectric stack. In an aspect, the method includes vibrating the flow generator at the resonance frequency of the flow generator.

It is to be understood that both the foregoing general description and the following detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following detailed description.

BRIEF DESCRIPTION OF THE DRAWINGS

The accompanying drawings illustrate embodiments of the devices and methods disclosed herein and together with the description, serve to explain the principles of the present disclosure.

DETAILED DESCRIPTION

Figure 1:
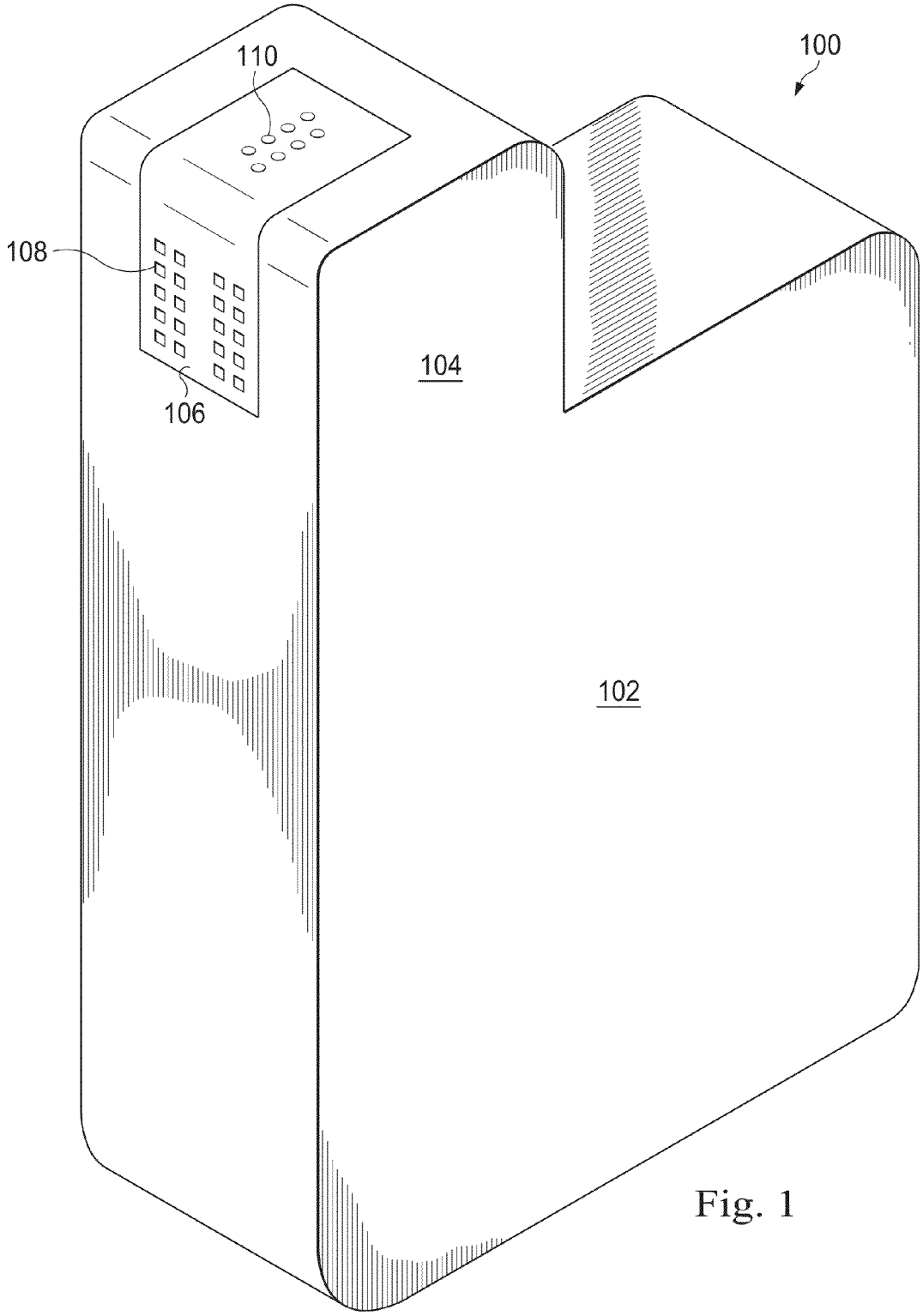
FIG. 1 is an illustration of a perspective view of an inkjet print cartridge according to one aspect of the present disclosure implementing the teachings and principles described herein.

For the purposes of promoting an understanding of the principles of the present disclosure, reference will now be made to the exemplary embodiments illustrated in the drawings, and specific language will be used to describe the same. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In particular, it is fully contemplated that the features, components, and/or steps described with respect to one embodiment may be combined with the features, components, and/or steps described with respect to other embodiments of the present disclosure. For the sake of brevity, however, the numerous iterations of these combinations will not be described separately. For simplicity, in some instances the same reference numbers are used throughout the drawings to refer to the same or like parts.

The present disclosure relates generally to fluid ejection systems and methods for acoustic streaming of a fluid. More particularly, the disclosure relates to acoustic streaming accomplished by vibrating a sharp edge to generate anomalous streaming. In general, the fluid ejection systems have few or no movable parts making them highly reliable, and they may be easily integrated with micro-fluidic circuits. In addition, the fluid ejection systems may be relatively easy to manufacture as they may be used/built in conjunction with MEMS (micro-electromechanical systems). They also may be customizable as they may be tunable to a wide range of conditions, and may have tunable jets for operations like dispensing a controlled microscopic amount of substance.

In some aspects, the system is an acoustic streaming fluid ejection system that may find particular utility in inkjet printers, drug delivery devices, and other ejection type systems. In one aspect, the disclosure relates to a mechanism that ejects microscopic fluid droplets out of a nozzle that can be used in Drop on Demand (DOD) inkjet printers, 3-D printers, industrial printing, 3-D printing for rapid prototyping, circuit board printing, LCD and OLED display production, and a number of other industries. These same systems may be used in drug delivery applications, diagnostics and drug design, and other technologies. The principle of operation is acoustic streaming of fluid from a sharp vibrating edge. An applied ultrasonic pulse ejects a single drop of fluid from a nozzle. The system may be optimized to eject desired sizes of droplets. When used in inkjet printing applications, the systems disclosed herein may reduce the costs of an inkjet head, may be tunable to change the size of droplets and may include producing sub-micron size droplets. In addition the system provides the ability to work with wide variety of fluids and solvents, including viscous materials such as polymer melts. Printing speeds may be increased and the system may have increased reliability and robustness of design.

FIG. 1 illustrates a view of an exemplary print cartridge 100. The cartridge includes a main body 102 and a nozzle member 104, and is configured to contain ink for printing on a surface of an item, such as paper, for example. The main body forms a fluid reservoir, and the fluid may be fed or may flow to the nozzle member for ejection from the print cartridge. Depending on the application, the reservoir may be filled with ink, with a non-water soluble fluid, with a drug for treating a health condition, or other type of fluid. When used in an inkjet printer, the print cartridge 100 may be carried on a printing carriage that is passed across the surface of the item. The print cartridge 100 is configured to eject droplets of ink to form printed characters, pictures, or other images. Printers are well known and will not be described further.

The nozzle member 104 comprises a material dispensing portion 106 with electrical contact pads 108 that connect via traces on the underside of the tape 106 to electrodes on a print-head substrate affixed to the underside of the tape 106. Nozzles 110 accommodate the ejection of ink onto the print surface.

Figure 2:
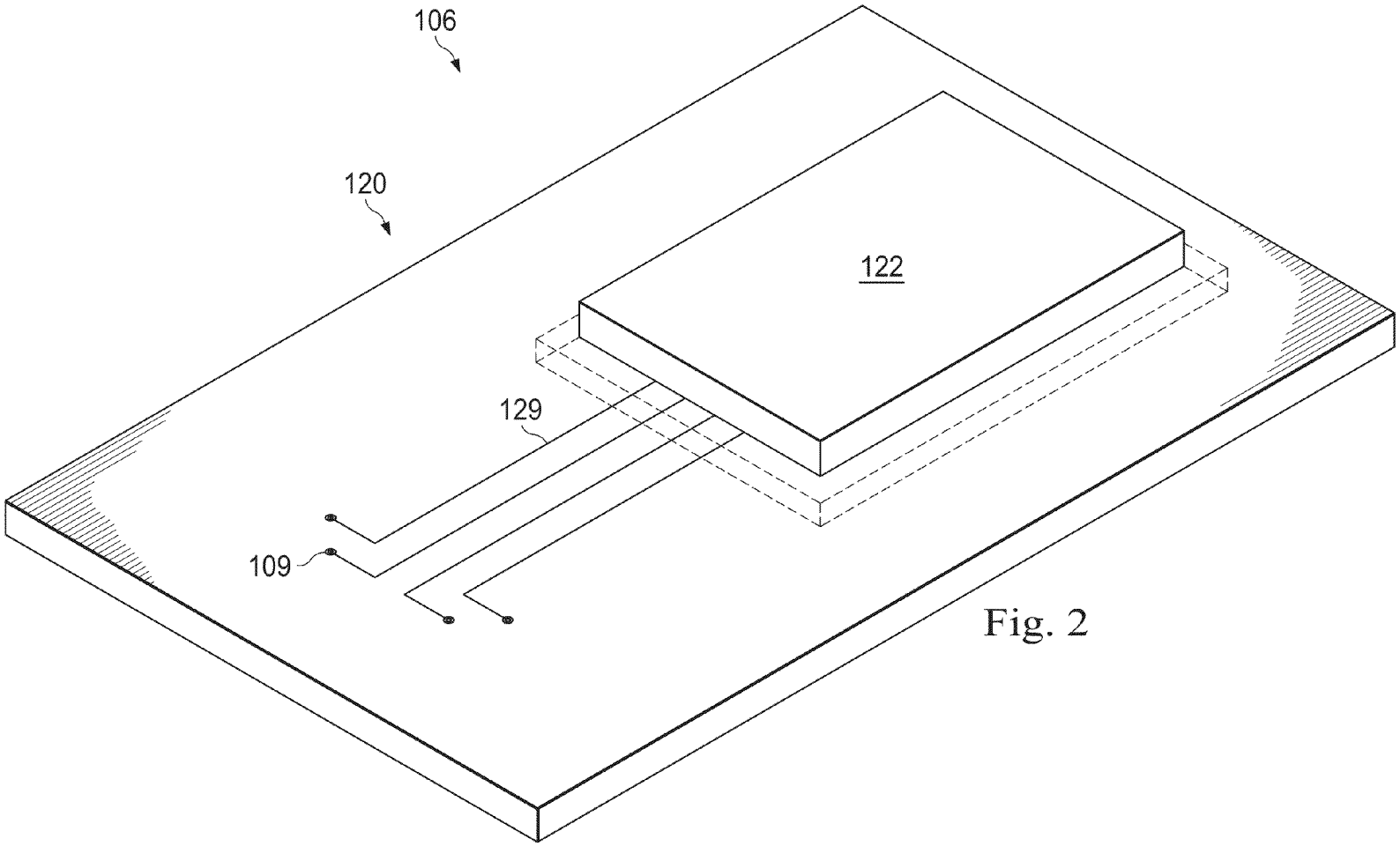
FIG. 2 is a perspective view of a back of a printhead assembly usable on the inkjet print cartridge of FIG. 1, according to one aspect of the present disclosure implementing the teachings and principles described herein.
Figure 3:
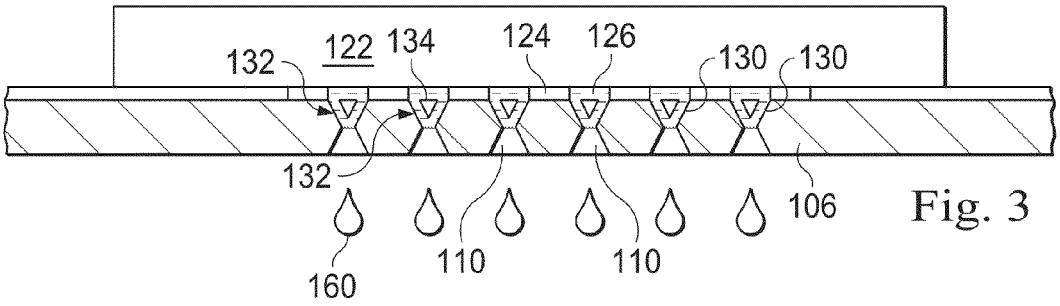
FIG. 3 is a cross-sectional view of a portion of the printhead assembly shown in FIG. 2 according to one aspect of the present disclosure implementing the teachings and principles described herein.

FIG. 2 shows a back surface of the material dispensing portion 106 of the print cartridge 100. The material dispensing portion 106 comprises a printhead assembly 120 that includes a mounted silicon printhead substrate 122. As shown in FIG. 3, a barrier layer 124 formed on the substrate 122 is shown containing fluid channels 126 such as ink channels that lead to acoustic streaming fluid ejection chambers, described below. Referring again to FIG. 2, the material dispensing portion 106 includes conductive traces 129 extending from electrodes on the substrate 122 to electrodes 109 that form the contact pads 108 (shown in FIG. 1).

FIG. 3 shows a side view cross-section taken through a portion of the material dispensing portion 106. FIG. 3 illustrates droplets of a fluid 160 being ejected through the nozzles 110 when fluid ejectors associated with each of the nozzles 110 are energized. The fluid channels 126 lead to acoustic streaming fluid ejection chambers 130 and to acoustic streaming ejection arrangements 132 at least partially disposed within the acoustic streaming fluid ejection chambers 130. Circuitry on the substrate 122 connects to the electrodes 109 (FIG. 2) and distributes the electrical signals applied to the electrodes 109 to the various acoustic streaming ejection arrangements 132.

Figure 4:
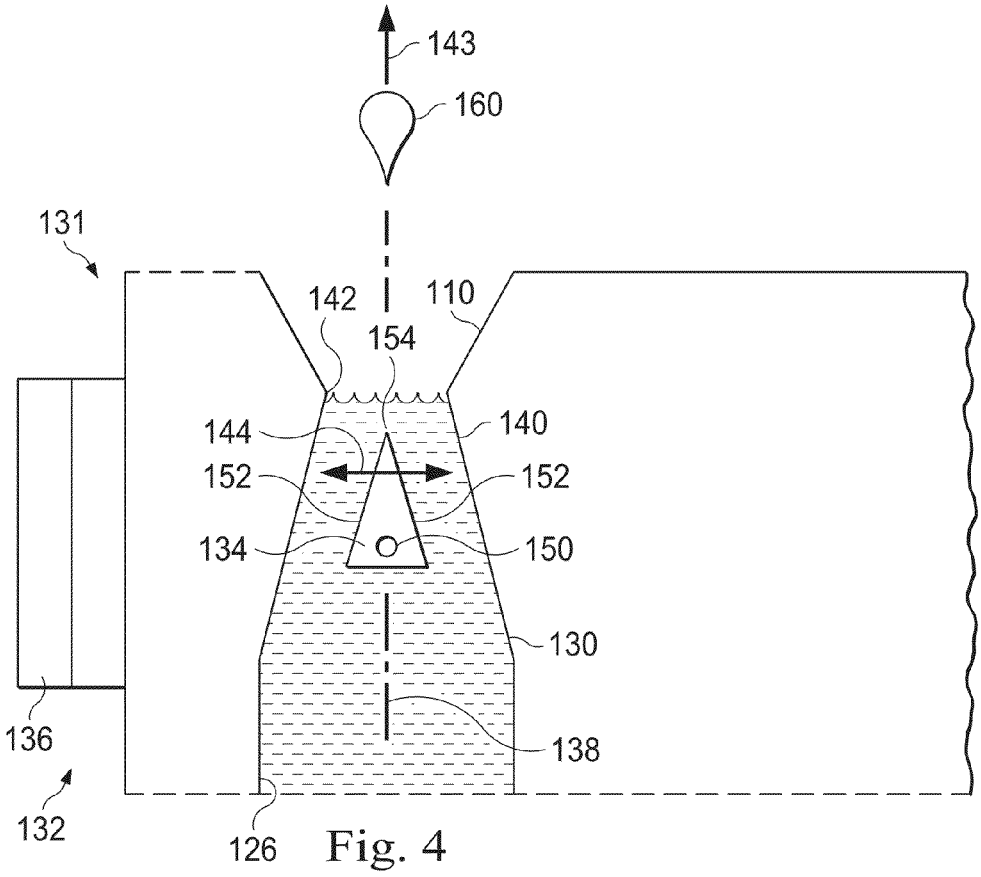
FIG. 4 is a schematic showing an exemplary acoustic streaming fluid ejector chamber and an acoustic streaming ejection arrangement according to one aspect of the present disclosure implementing the teachings and principles described herein.

FIG. 4 shows an example of a fluid ejector 131 formed of an acoustic streaming fluid ejection chamber 130 with an acoustic streaming ejection arrangement 132. The acoustic streaming fluid ejection chamber 130 is shaped to form an ejection nozzle 140 having a neck 142. Here, the neck 142 also serves as an exit port out of the acoustic streaming fluid ejection chamber 130. The acoustic streaming fluid ejection chamber 130 in this embodiment is a lumen and includes a central axis 138. The lumen may have any shape that enables passage of fluid from one location to another. In this embodiment, the acoustic streaming ejection arrangement 132 includes a flow generator 134 and a vibration-generating driving device 136. The flow generator 134 is contained within the acoustic streaming fluid ejection chamber 130.

The flow generator 134 is configured and arranged to physically displace the fluid in the acoustic streaming fluid ejection chamber 130 in a forward direction, which is in the direction of arrow 143. Here, the flow generator 134 is disposed directly in the fluid flow and is centrally disposed along the central axis 138 of the acoustic streaming fluid ejection chamber 130. Accordingly, it is surrounded by fluid in the acoustic streaming fluid ejection chamber 130. In some embodiments, the flow generator 134 is a wedge-shaped microscopic blade and is arranged to vibrate at a particular frequency back and forth in a translational or non-pivoting manner as indicated by the arrow 144 in FIG. 4. Accordingly, the flow generator 134 may vibrate perpendicular to the direction of the axis 138. In some embodiments, the flow generator 134 may pivot about a pivot point in a side-to-side vibratory manner. The flow generator 134 is connected to walls or sides of the acoustic streaming fluid ejection chamber 130 at an attachment point 150.

Figure 5:
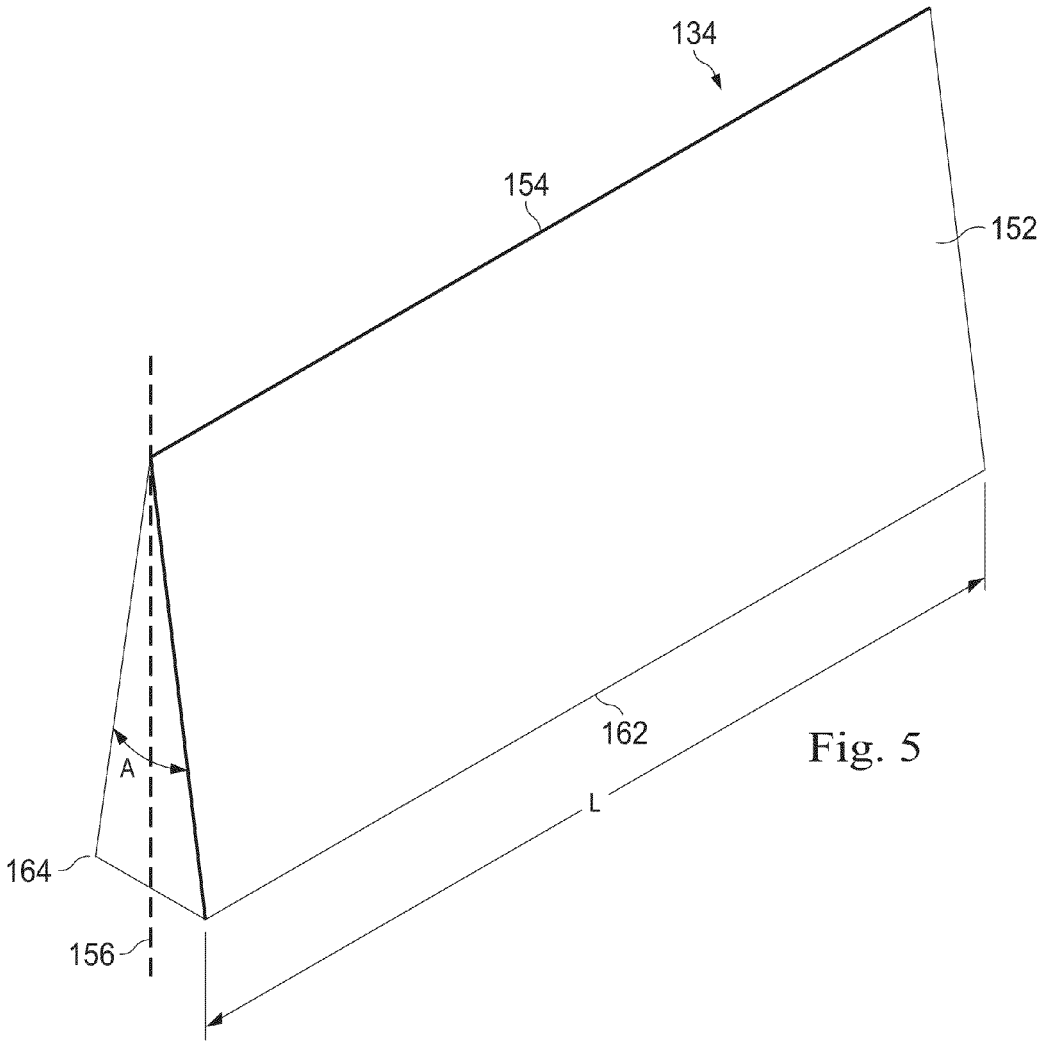
FIG. 5 is a schematic of an exemplary fluid flow generator of the acoustic streaming ejection arrangement of FIG. 4 according to one aspect of the present disclosure.

The flow generator 134 is shown in greater detail in FIG. 5. With reference to both FIGS. 4 and 5, the flow generator 134 includes angled, non-parallel sides 152 converging at a sharp edge 154. In this embodiment, the sharp edge 154 has a protruding lateral length L, as can be seen in FIG. 5. In the embodiment, shown the two non-parallel sides 152 form an angle A at the sharp edge 154 of about 20 degrees. However, other angles are contemplated. For example, in some embodiments, the angle A forming the sharp edge 154 is formed at an angle between 10 and 90 degrees. In some embodiments, the angle A is formed at an angle between 10 and 60 degrees, and in some embodiments, angle A is formed at an angle between 15 and 30 degrees. In some embodiments, the angle A is about 30 degrees. Other ranges are also contemplated. The sharper the angle A, the higher the streaming velocities that may be achieved by the acoustic streaming fluid arrangement. Here the sides 152 are symmetrically formed about an axis 156. In FIG. 4, the axis 156 aligns with the lumen axis 138. In other embodiments, the edges 162, 164 of the flow generator 134 may be rounded or smoothed to reduce or prevent unnecessary streaming or turbulence.

Depending on the embodiment and the amount of fluid to be driven by the pump, the flow generator 134 may have a lateral length L in the range of about 50 microns to 5 cm. In other embodiments, the lateral length L is in the range of about 100 microns to 2 cm. While the flow generator 134 may be formed of any material, in some embodiments, the flow generator 134 may be in the form of a steel blade with a 20° sharp edge. In some exemplary embodiments, the flow generator 134 includes two rounded edges 162, 164 so that only the edge 154 is sharp. In some instances, the flow generator 134 may form a tear-drop shape in cross-section.

Returning to FIG. 4, the vibration-generating driving device 136 is disposed outside the acoustic streaming fluid ejection chamber 130 and is configured to provide an activating force to the flow generator 134 in the acoustic streaming fluid ejection chamber 130. In some embodiments, the driving device 136 is one or more piezoelectric crystals that may form a piezoelectric crystal stack. When alternating current of a particular frequency is passed through the piezoelectric crystal stack, the stack vibrates at this frequency that may be used to mechanically drive the flow generator 134. In other embodiments, the driving device 136 is an inductive device configured to generate a magnetic field that may drive the flow generator 134. Accordingly, in such embodiments, the flow generator 134 is formed from a magnetic material. The driving device 134 may be or may form a part of other driving systems. Depending on the driving device 136, the principle of vibration generation can be, for example, piezoelectric or inductive. Other principles of vibration generation are also contemplated.

In some exemplary embodiments, the driving device 136 is mechanically connected to the flow generator 134 by an extending shaft (not shown). The extending shaft is a rigid shaft capable of translating the vibrations from the driving device 136 to the flow generator 134. Embodiments using inductive magnetic fields to impart vibration to the driving device may perform without a mechanical connection. Other embodiments vibrate the acoustic streaming fluid ejection chamber 130 without vibrating the flow generator 134 to induce a relative vibration between the fluid and the flow generator.

Figure 6:
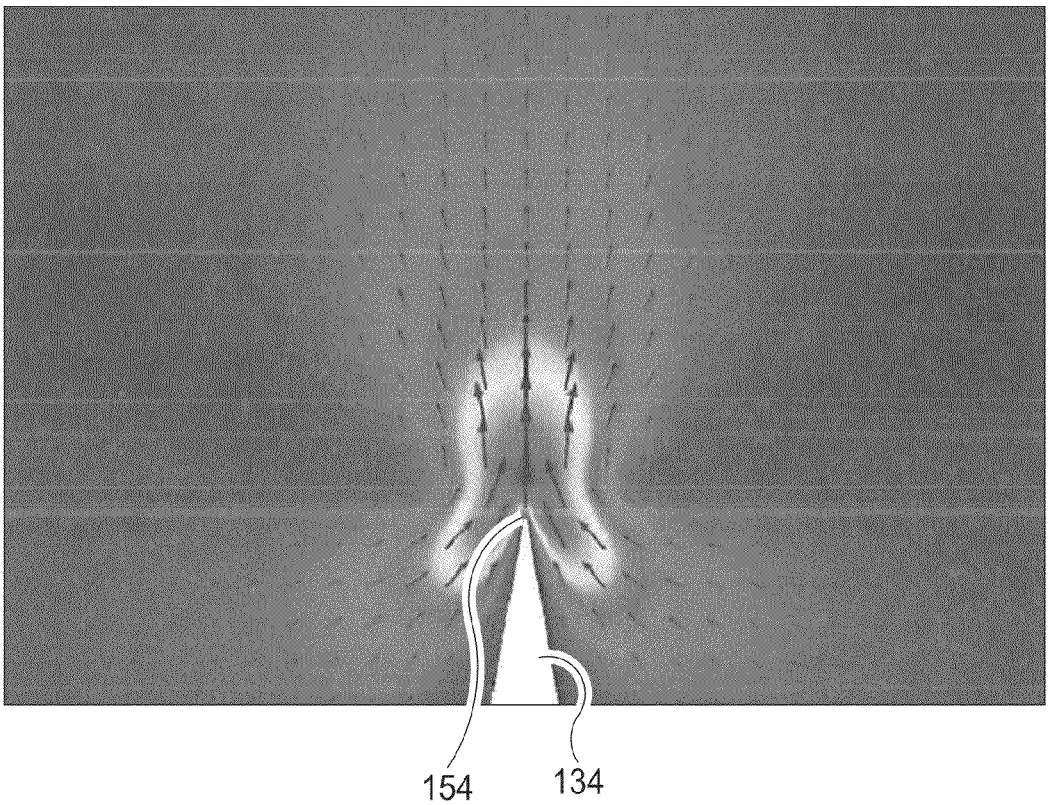
FIG. 6 is an illustration showing the principles of acoustic streaming jet flow obtained using the principles of the present disclosure.

Acoustic streaming that is accomplished by the system in FIG. 4 is a steady streaming flow that is generated due to oscillatory motion of a sharp-edged body in a fluid. The steady streaming flow is represented in the drawing of FIG. 6. Anomalous jets of fluid are generated by and originate from the vibrating sharp edge 154 of the microscopic flow generator 134. In FIG. 6, the vectors represent the fluid velocity of the jets, and as can be seen, the velocity is much greater at the sharp edge 154. The velocities of the jets can be as high as 2 m/s and are significantly higher than can be predicted by smooth edges vibrating laterally. As shown in FIG. 6, the jets of fluid extend substantially perpendicular to the movement of the flow generator 134 in the same direction as the edge 154 and parallel to the axis 156 in FIG. 5.

The anomalous streaming occurs at the sharp edge 151 of the wedge-shaped flow generator 134. The flow generator 134 vibrates perpendicular to its cutting edge 154 and generates a strong microscopic current in the direction of the edge 151 shown in the FIG. 6. The spatial extent of this current depends on at least two factors, including the frequency of flow generator 134 vibrations and viscosity of a fluid. For ultrasonic frequencies in water, the current around the flow generator 134 is localized to an area of several microns from the flow generator 134. The forces that produce such currents are very strong and can easily overcome the surface tension of water and other fluids, which allows the use of this phenomenon to effectively generate fluid droplets from a surface. Thus, the acoustic streaming from the sharp edge 154 is typically highly localized at the sharp edge with the dimensions that are much smaller than the acoustic wavelength. Because of the sharp edge 154 and the tapering sides 152 of the flow generator 134, the streaming is well localized at the sharp edge 154 and thus does not depend on the overall geometry of the flow generator 134 or the fluid around the flow generator 131.

FIG. 6 also shows the vector field of the frequency dependent fluid velocity. In some examples, the fluid velocity is observed to be the highest just above the edge 154. The flow pattern consists of the stream directed vertically away from the sharp edge 154 which is fed by the streams coming from the sides. This pattern has proven to be universal for all angles of the sharp edge, fluid viscosities and frequencies of vibration. As indicated above, it should be recognized however, the sharper the edge 154 (or the smaller the angle A in FIG. 5), the higher the streaming velocities.

To induce the streaming, the flow generator 134 may be vibrated at its resonance frequency. In some embodiments, the flow generator 134 may be vibrated at its resonance frequency within a range of about 100 Hz to 10 MHz, for example. In an example where the flow generator 134 was a steel blade with a 20° sharp edge on one end, the vibration-generating driving device 136 vibrated the flow generator 134 at its resonance frequency which happened to be 461 Hz in water. For explanatory purposes, the acoustic motion introduces a boundary layer along the walls of the flow generator 134. The boundary layer is a low pressure acoustic force area, and it creates a path for fluid to enter. The fluid enters the acoustic force area along the sides of the flow generator 134 and is ejected at the sharp edge 154 driven by the centrifugal force. This results in the streaming pattern from the sharp edge 154.

In some embodiments, the flow rates may be tunable on the fly by modifying the power levels at the driving device 136. For example, increasing or decreasing the power applied to the flow generator 134 by the driving device 136 may result in an increased or decreased vibrational rate of the flow generator 134, thereby increasing or decreasing the resulting streaming fluid flow. As such, the flow rate and the pressure level may be controlled to desired levels.

Returning to FIG. 4, the ejection nozzle 140 and the flow generator 134 are disposed so that the neck 142 is located immediately downstream of the edge 154 of the flow generator 134. The flow generator 134 is positioned inside the nozzle 140. The flow generator 134 can be attached to the bottom of a chamber or to the walls of the ejection nozzle 140 at the attachment point 150, as shown in FIG. 4. In the exemplary embodiment of FIG. 4, the attachment point 150 connects the flow generator 134 to the vibration driving device 136 in a manner that moves the flow generator 134 in a non-pivoting translational direction. In other implementations, the flow generator 134 may be pivotably attached at attachment point 150. Thus, when activated, the flow generator 134 rapidly oscillates about the attachment point 150 to generate fluid flow.

In use, a fluid such as ink, a drug, or other fluid may be carried within the body 102 of the cartridge 100 and fed from the body 102 to the fluid ejector 131 formed of the acoustic streaming fluid ejection chamber 130 and the acoustic streaming ejection arrangement 132. With the flow generator 134 surrounded by the fluid in the acoustic streaming fluid ejection chamber 130, the fluid ejector 131 is prepared to eject one or more droplets of fluid from the neck 140 forming the opening of the acoustic streaming fluid ejection chamber 130. Current directed to the driving device 136 activates the driving device 136. Vibrations induced in the driving device 136 may be mechanically conveyed to the flow generator which then vibrates within the acoustic streaming fluid ejection chamber 130. In some embodiments, vibrations may be induced by inductive coupling as explained above, without a mechanical connection. The flow generator 134 may vibrate at its resonance frequency to eject one or more fluid droplets, or even create a stream of fluid, through the opening in the acoustic streaming fluid ejection chamber 130. The geometry of the arrangement 132 and the ultrasonic frequency of the flow generator 134 can be optimized for a desired size of droplets.

While this disclosure describes the acoustic streaming as a mechanism for ejecting fluid droplets out of a nozzle that can be used in Drop on Demand (DOD) inkjet printers, 3-d printers, and related technologies, the same principles may be used in other industries and applications. For example, the acoustic ejectors and systems disclosed herein may find particular utility in fluidic micropumps, diagnostics and drug design, purging operations in small biological volumes, implants, medical instruments and tools, drug delivery, ink-jet printing devices, and fuel cells, among others. In some instances, the principles of the present disclosure may be used as drug delivery devices (ocular, nasal, etc.) and as a reagent delivery system in combinatorial chemistry and high throughput screening devices for drug discovery and DNA sequencing, it also has point-of-care utility, like on a lab-on-a-chip scenario. In these scenarios, specific size droplets or fluid flow may be required and produced using the systems and methods described herein. For example, gene sequencing applications may require specific droplet sizes or fluid flow that may be achieved using the systems and methods described herein.

The system disclosed herein may result in cost savings and a tunable droplet size, including rendering sub-micron size droplets. In addition, the system disclosed herein is not limited to water soluble fluids, but may work with a wide variety of fluids and solvents, including viscous materials such as polymer melts. In addition the speeds of printing may be improved, and the reliability and robustness of the system may exceed others as the designs disclosed herein include few if any moving parts.

Persons of ordinary skill in the art will appreciate that the embodiments encompassed by the present disclosure are not limited to the particular exemplary embodiments described above. In that regard, although illustrative embodiments have been shown and described, a wide range of modification, change, and substitution is contemplated in the foregoing disclosure. It is understood that such variations may be made to the foregoing without departing from the scope of the present disclosure. Accordingly, it is appropriate that the appended claims be construed broadly and in a manner consistent with the present disclosure.

What is claimed is:

1. An acoustic streaming fluid ejector, comprising:
- a fluid filled chamber having an opening;
- a selectively vibrating flow generator having a sharp edge pointed toward the opening; and
- a driving device configured to vibrate one of the flow generator and the chamber to create a streaming fluid flow in a direction away from the sharp edge through the opening.

2. The acoustic streaming fluid ejector of claim 1, wherein the flow generator comprises two nonparallel surfaces forming an angle, the nonparallel surfaces being symmetrically disposed about an axis aligned with an axis through the opening.

3. The acoustic streaming fluid ejector of claim 2, wherein the two nonparallel surfaces converge to form the sharp edge.

4. The acoustic streaming fluid ejector of claim 2, wherein the sharp edge has an angle of 90 degrees or less.

5. The acoustic streaming fluid ejector of claim 1, wherein the driving device is configured to vibrate the flow generator at the resonance frequency of the flow generator.

6. The acoustic streaming fluid ejector of claim 1, wherein the driving device comprises one of piezoelectric stack and a coil.

7. The acoustic streaming fluid ejector of claim 1, wherein the opening is disposed directly proximate the sharp edge of the flow generator.

8. The acoustic streaming fluid ejector of claim 1, wherein the fluid is a drug for treating a condition.

9. The acoustic streaming fluid ejector of claim 1, wherein the fluid is an ink.

10. The acoustic streaming fluid ejector of claim 1, wherein the fluid is non-water soluble.

11. An acoustic streaming fluid ejector, comprising:
- a fluid reservoir;
- a fluid filled chamber in communication with the reservoir, the chamber having an opening;
- a selectively vibrating flow generator having a sharp edge; and
- a driving device configured to vibrate one of the flow generator and the chamber to create a streaming fluid flow in a direction away from the sharp edge in the chamber.

12. The acoustic streaming fluid ejector of claim 11, wherein the flow generator comprises two nonparallel surfaces forming an angle, the nonparallel surfaces being symmetrically disposed about an axis aligned with an axis through the opening.

13. The acoustic streaming fluid ejector of claim 11, wherein the sharp edge has an angle of 90 degrees or less.

14. The acoustic streaming fluid ejector of claim 11, wherein the driving device is configured to vibrate the flow generator at the resonance frequency of the flow generator.

15. The acoustic streaming fluid ejector of claim 11, wherein the driving device is a piezoelectric stack.

16. The acoustic streaming fluid ejector of claim 15, wherein the two nonparallel surfaces converge to form the sharp edge.

17. The acoustic streaming fluid ejector of claim 11, wherein the driving device is configured to vibrate the flow generator at the resonance frequency of the flow generator.

18. A method comprising:
- providing a flow generator in a fluid-filled chamber having an opening, the flow generator having a sharp edge defined by two nonparallel surfaces forming an angle, the nonparallel surfaces being symmetrically disposed about an axis aligned with an axis through the opening; and selectively vibrating the flow generator with a driving device to vibrate the sharp edge of the flow generator to eject a fluid droplet from the chamber and out of the opening.

19. The method of claim 18, wherein vibrating the flow generator with a driving device comprises vibrating the flow generator with a piezoelectric stack.

20. The method of claim 18, further comprising vibrating the flow generator at the resonance frequency of the flow generator.

* * * * *